United States Patent [19]

MacLean

[11] Patent Number: 4,985,200

[45] Date of Patent: Jan. 15, 1991

[54] METHOD OF MAKING SINTERED ALUMINIUM NICKEL ALLOYS

[75] Inventor: Murdo S. MacLean, Glasgow, Scotland

[73] Assignee: The Secretary of State for Defence in Her Britannic Majesty's Government of the United Kingdom of Great Britain and Northern Ireland, London, England

[21] Appl. No.: 488,074

[22] PCT Filed: Oct. 19, 1988

[86] PCT No.: PCT/GB88/00879

§ 371 Date: Jun. 19, 1990

§ 102(e) Date: Jun. 19, 1990

[87] PCT Pub. No.: WO89/03897

PCT Pub. Date: May 5, 1989

[30] Foreign Application Priority Data

Oct. 19, 1987 [GB] United Kingdom ..... 8724465

[51] Int. Cl.[5] ..... B22F 1/00

[52] U.S. Cl. ..... 419/19; 719/23; 719/30; 719/12; 719/13; 419/17

[58] Field of Search ..... 419/19, 23, 30, 12, 419/13, 17

[56] References Cited

U.S. PATENT DOCUMENTS

| | | | |
|---|---|---|---|
| 3,893,844 | 7/1975 | Nadkami | 419/19 |
| 4,077,816 | 3/1978 | Nadkami | 419/19 |
| 4,274,873 | 6/1981 | Nadkami | 419/19 |

*Primary Examiner*—Stephen J. Lechert, Jr.

*Attorney, Agent, or Firm*—Nixon & Vanderhye

[57] ABSTRACT

In a method of producing a sintered aluminium nickel alloy particles of powder are formed with nickel surfaces (either on nickel or on ceramic material). The surface of the nickel is oxidised and these particles are then mixed with aluminium powder and the mixture sintered in known fashion.

9 Claims, No Drawings

METHOD OF MAKING SINTERED ALUMINIUM NICKEL ALLOYS

This invention relates to sintered aluminium nickel alloys, and in particular to such alloys containing ceramic materials.

An industrial requirement exists for aluminium alloys which have high temperature strength and stability coupled with good wear resistance. The problem of satisfying both requirements in a single material presents considerable difficulty.

Conventional aluminium alloys containing copper or magnesium exhibit age hardening, and although these alloys have good mechanical properties at relatively low temperatures, unfortunately they have low wear resistance. Furthermore, at temperatures in excess of 180° C. these alloys overage, resulting in deterioration of strength.

For the production of pistons, cylinder liners, or for other applications where a combination of high temperature strength and wear resistance is required, aluminium based casting alloys containing high levels of silicon, together with some copper and other ingredients are currently used. However, the use of silicon has the adverse effect of lowering the melting point of the alloy by about 90° C., and, depending upon the other additions, this may be as much as 125° C. below that of pure aluminium. This reduces the high temperature strength and increases the tendency to heat cracking.

In U.K. Patent No. 1331145 there is disclosed a sintered aluminium alloy composition comprising 5 to 10% of iron, nickel or chromium together with 0.5 to 5% of silicon carbide. These alloys are said to exhibit good high temperature strength and wear resistance. However, the processing route required to realise these advantages in practice has been reported elsewhere as complex, and to require cold pressing, warm repressing, and subsequent hot forging to final shape.

The problems inherent in the production of sintered aluminium alloys including iron, nickel or chromium arise from the fact that an intense exothermic reaction occurs during the sintering process. In the course of the reaction the aluminium melts, and there is an abrupt expansion of the sintering mass, and local weaknesses occur in the resultant alloy. The problems are well documented for the case of iron/aluminium, (with a preponderance of iron), in, for example, articles "Powder Metallurgy of Iron-Aluminium" by J. S. Sheasby in Volume 15 No. 4, 1979, pages 301–305 of The International Journal of Powder Metallurgy and Powder Technology, and "Sintering Behaviour of Iron-Alloy Powder Mixes" by D. J. Lee and R. M. German in Volume 21 No. 1, 1985, pages 9–20 of the same Journal.

Aluminium alloys having compositions similar to those of UK-A-13811145, but produced by processes other than Powder Metallurgy (sintering being a Powder Metallurgy process) are described in many publications. For example U.K. Patent Application No. 2088409A and U.S. Pat. No. 4,347,076 describe the production of alloys by the rapid cooling (typically $10^5$ degrees C. per second) of molten mixtures. This is a method requiring complicated and expensive equipment. U.K. Patent No. 1498357 describes electrical conductors made by a method involving extrusion, and U.K. Patent No. 868769 describes an alloy produced by compression and extrusion "to produce a shearing effect" of a mixture. U.K. Patent No. 846,530 also describes an alloy produced by hot-working, it being a requirement of the claimed alloy that "the iron-containing constituent in the hot-worked article (is) present in the form of finely divided uniformly distributed insoluble particles having a maximum thickness of 0.4 micron". U.K. Patent No. 516474 describes a method of producing an abrasive article containing "abrasive grains, for example, diamonds, and a sintered bond consisting entirely of aluminium or an aluminium base alloy". The method claimed involves the formation of a powdered mixture of abrasive, aluminium and a metal, pressurising to deform the metal particles, and then sintering.

The present Applicant's Patent GB No. 2179369B describes a method of producing a sintered aluminium alloy having good high temperature strength, wear resistance, and a relatively simple production route.

The Applicant has now found an improved method of producing a sintered aluminium nickel alloy.

According to the present invention a method of producing a sintered aluminium nickel alloy includes the steps of oxidising the surface of particles of nickel powder, mixing the surface oxidised particles with aluminium powder, and sintering the mixture.

In an extension of this method particles of ceramic powder are coated with nickel, the surface of which is oxidised, the resultant powder being mixed with aluminium powder and sintered.

The aluminium in the aluminium powder may already be in an alloyed form.

The use of nickel oxide, as a heat-reducible metal oxide, as an oxidising agent, has been described in Austrian Patent No. 345,569, which is concerned with a process for the production of dispersion hardened metals. Dispersion hardened metals, as defined in that patent, are solid-solution alloys of a relatively noble base metal having a relatively low heat of oxide formation or free energy of oxide formation and a dissolved metal with a relatively high heat of oxide formation or free energy of oxide formation which are heated under oxidising conditions in order to preferentially oxidise the dissolved metal. The patent teaches, inter-alia, the improvements of using a powdered mixture of oxidising agent of heat-reducible metal oxide and hard heat-resistant metal oxide. In one example therein the relatively noble base metal is Nickel (98.86%), the solute metal is Aluminium (1.14%) and the oxidising agent made from 4.68 parts of Nickel Oxide and 0.08 parts of Aluminium Oxide.

The present invention relates to alloys, notto solutions as in Austrian Patent No. 345,569, and the temperatures involved are significantly different, as are the proportions of Nickel and Aluminium, the present invention generally having Nickel present within the range 4 to 16% by weight. Also the present invention does not involve Nickel Oxide per se—the nickel oxide is present as a thin surface layer on a particle which may be of nickel or of ceramic coated with nickel.

In the Applicant's patent GB No. 2179369, it is described how, by controlling the particle sizes of the constituents, aluminimum and at least one of iron, nickel and chromium, and by sintering a green compact of these constituents at a temperature below the melting point of pure aluminum but sufficient to initiate an exothermic reaction, the effects of that exothermic reaction can be reduced to an extent where a sintered aluminium alloy can be obtained which has properties otherwise achieved by more complicated processes.

The Applicant has now found that when nickel is the second constituent in the method of GB No. 2179369B:

a. an exotherm starts at about 530° C.
b. the exotherm is less intense than with iron
c. localised temperatures are lower
d. a liquid phase sinter is still obtained
e. an intermetallic Al Ni is obtained, and this improves the strength of the resultant sinter
f. there is minimum segregation in the aluminium alloy material (for example 6001 or 2016 alloys)
h. densification occurs during sintering, and;
i. the sintering cycles are shorter.

It has also been found that improved results are obtained by selective oxidation of the nickel particles—that is by oxidising the surface only of the nickel particles. This has been found to intensify the exotherm, or to generate an exotherm in specific conditions (it has been found that with 10% HDNP nickel in 45 micron aluminium powder there is no exotherm).

The nickel particle size should preferably be in the range of 1.5 to 20 microns and the surface oxide levels between 500 and 2000 ppm.

The selective oxidation process can also be used when ceramics are included in the sintering mixture. The ceramics must be of the type, such as, for example, ceramics carbides, borides or nitrides, which can be nickel coated by, for example, the Sherrif process or by the dissipation of Nickel Carbonyl gas in a tower or chamber. The ceramic material is preferably in the form of particles in excess of 10 microns, and is preferably coated with nickel to a thickness between 3 and 15 microns. The nickel coating is then selectively oxidised to surface oxide levels between 500 and 2000 ppm.

By using nickel coatings on ceramic particles an exotherm is produced which causes localised melting around each ceramic particle, thus locking it into the final matrix. A liquid phase sinter is created with subsequent densification to virtual theoretical density.

The percentage of nickel powder relative to aluminium powder should be within the range 4 to 16% by weight and, in the production of sinters containing ceramics, should be greater than 10% by weight.

Suggested materials for use with the invention are:

As the base matrix powder a. Pure aluminium powder
b. Prealloyed powder to compositions to alloys 6061 or 2014 any suitable alloy of particle size less than 125 microns, preferably less than 45 microns
c. Elemental alloys to 6061 or 2014 compositions or any compositions or any suitable composition.

The Nickel Powder as the reactive material may be of the types

| |
|---|
| a. Carbonyl Nickel type 123 |
| b. Carbonyl Nickel type 254 |
| c. Carbonyl Nickel type 255 |
| d. Carbonyl Nickel type HDNP |

After convential composition, for example, as in GB No. 2179369B, the mixture should be sintered at 610° nominally to produce an exothermal reaction.

In practice, when an exotherm has been found difficult to generate, selective oxidation has been found to produce conditions compatible to the formation of an exotherm.

When small additions of the ceramic or wear resistant coating are being made: e.g.—less than 10% to encourage the exotherm, additional Nickel powder may be added to bring the total nickel content to around 10% or greater.

What is claimed is:

1. A method of producing a sintered aluminium nickel alloy wherein the ratio of nickel present in 4 to 16% by weight including the step of oxidising nickel surfaces of powder particles, mixing the surface oxidised particles with aluminium powder, and sintering the mixture.

2. A method of producing a sintered aluminium nickel alloy as claimed in claim 1 wherein the nickel surfaces are on particles of nickel powder.

3. A method of producing a sintered aluminium nickel alloy as claimed in claim 1 wherein the nickel surfaces are on particles of ceramic powder.

4. A method of producing a sintered aluminium nickel alloy as claimed in claim 3 wherein the ratio of nickel to aluminium is at least 10% by weight.

5. A method of producing a sintered aluminium nickel alloy as claimed in claim 1 wherein the aluminium in the aluminium powder is in an alloyed form.

6. A method of producing a sintered aluminium nickel alloy as claimed in claim 2 wherein the particles of nickel powder are 1.5 to 20 microns in size.

7. A method of producing a sintered aluminium nickel alloy as claimed in claim 3 wherein the particles of ceramic powder are of a size in excess of 10 microns.

8. A method of producing a sintered aluminium nickel alloy as claimed in claim 3 in which the nickel surfaces are between 3 and 15 microns thick.

9. A method of producing a sintered aluminium nickel alloy as claimed in claim 1 wherein the nickel surfaces are oxidised to levels of between 500 and 2000 ppm.

* * * * *